United States Patent [19]

Doll et al.

[11] Patent Number: 4,833,122

[45] Date of Patent: May 23, 1989

[54] IMAGABLE CLEAN RELEASE LAMINATE CONSTRUCTION

[75] Inventors: Gary Doll, Englewood, Ohio; William T. Paulson, Big Pine Key, Fla.; William F. Pinell, Lebanon, Ohio

[73] Assignee: The Standard Register Company, Dayton, Ohio

[21] Appl. No.: 68,837

[22] Filed: Jul. 1, 1987

[51] Int. Cl.[4] ..... B41M 5/18; B41M 5/22

[52] U.S. Cl. ..... 503/226; 427/152; 428/40; 428/913; 428/914; 503/200

[58] Field of Search ..... 503/200, 226; 428/321.5, 914, 195, 40, 913; 427/150–152

[56] References Cited

U.S. PATENT DOCUMENTS

| | | | |
|---|---|---|---|
| 3,383,121 | 5/1968 | Singer | 282/28 |
| 3,565,463 | 2/1971 | Taylor | 282/71 |
| 4,029,341 | 6/1977 | Neill et al. | 282/22 R |
| 4,172,605 | 10/1979 | Welsch et al. | 427/150 |
| 4,204,706 | 5/1980 | Blum et al. | 283/21 |
| 4,250,216 | 2/1981 | Janssen | 428/78 |
| 4,277,089 | 7/1981 | Lockhart | 282/27 R |
| 4,374,274 | 8/1982 | Janssen | 428/78 |
| 4,479,838 | 10/1984 | Dunsirn et al. | 156/247 |
| 4,654,251 | 3/1987 | Okada et al. | 428/202 |
| 4,747,619 | 5/1988 | Sager | 282/9 R |

*Primary Examiner*—Bruce H. Hess

*Attorney, Agent, or Firm*—Killworth, Gottman, Hagan & Schaeff

[57] ABSTRACT

A laminate construction is provided which includes a backing sheet, a face sheet covering at least a portion of the backing sheet, and a releasable adhesive securing the face sheet to the backing sheet. The construction also includes first and second compositions which, when combined, form a distinctive color. The compositions are so arranged in the construction so that the application of an imaging force to the face sheet causes the compositions to combine and produce a color in the area beneath the imaging force. The face sheet can be peeled away to provide a nontacky label or the like, while a duplicate copy of the information printed onto the face sheet remains on the backing sheet. The construction may also include one or more intermediate plies which provide additional copies of the information.

23 Claims, 2 Drawing Sheets

IMAGABLE CLEAN RELEASE LAMINATE CONSTRUCTION

BACKGROUND OF THE INVENTION

This invention relates to an imagable clean release laminate construction, and in particular to a construction in which a releasable adhesive secures together two or more sheets which can be imaged through the use of chemical carbonless techniques.

Numerous types of businesses produce a wide variety of labels, nameplates, identification cards tags, forms, and the like in large quantities. Each such product typically has specific indicia printed thereon by high speed printing devices. It is desirable to produce such products on a continuous web, with individual labels, forms, or the like being adhesively attached to the web.

In the past, pressure sensitive adhesives have been utilized to secure the products to a continuous web during printing. Typically, labels or the like were attached to a silicone release liner by a pressure sensitive adhesive. Customarily when the pressure sensitive adhesive label was removed from the release liner, the label was attached to another surface by means of the tacky adhesive backing on the label.

However, in some instances, it is desirable to be able to have both surfaces of a label or the like, and also the surface of the web from which the label is released, to be clean and non-tacky. Such products are known as clean release products and are typically used as sew on labels, nameplates, and identification cards.

Previously, such clean release products have been made through the use of so-called releasable or fugitive adhesives. These releasable adhesives exhibit cohesive (internal) failure instead of the usual adhesive/adherend failure exhibited by typical pressure sensitive adhesives. These releasable adhesives are compositions which form relatively weak bonds but which adhere well to paper and other surfaces. Failure occurs within the releasable adhesive film itself when a layer of a laminate is subjected to peeling forces. This class of adhesives can be formulated to provide a range of cohesive strengths.

When cohesive failure occurs in such releasable adhesives a thin film of adhesive remains on the back surface of the face sheet, on the face of the backing sheet or both. However the film does not exhibit tack and has no adverse effect on the appearance or handling characteristics of the product. Moreover the surface can be readily printed on.

In some instances it is desirable to have a product which can be imprinted and which has the added function of providing one or more duplicate copies of the printed information. For example, Singer, U.S. Pat. No. 3,383,121, teaches a self-adhesive copy label which is affixed to a backer sheet by means of a pressure sensitive adhesive. Singer utilizes a multilayer structure which includes a self-contained carbonless sheet which produces the duplicate copy when the label is subjected to printing impact forces. However, in the Singer structure, care has to be taken to isolate the carbonless reactants from the pressure sensitive adhesive layer. Moreover, the labels of Singer have a tacky surface after delamination.

Likewise, Lockhart, U.S. Pat. No. 4,277,089, teaches the use of a removable label product which is adhered to a backer sheet through the use of pressure sensitive adhesive. The backer sheet itself comprises a self-contained carbonless product which provides a duplicate copy when the face sheet is subjected to impact printing forces. Like Singer the peelable label of Lockhart has a tacky surface.

Accordingly, the need still exists in the art for a clean release product which can provide a duplicate copy of information printed onto a face sheet or label and which can be readily removed from a laminate construction resulting in both a nontacky top sheet or label and a non-tacky web or backing sheet surface.

SUMMARY OF THE INVENTION

The present invention meets that need by providing a laminate construction in which the face sheet may be imprinted with legible information which is duplicated beneath a face sheet on one or more intermediate sheets and a backing sheet. The face sheet can then be readily peeled from the construction and be used as a label, tag, form, or the like. The underlying sheets retain the same information as the face sheet. All elements of the construction have nontacky surfaces, permitting easy handling and storage.

In accordance with one aspect of the invention, a laminate construction is provided comprising a backing sheet, which may be in the form of a continuous web, and a face sheet covering at least a portion of the backing sheet. A releasable adhesive secures a first or lower surface of the face sheet to a first or upper surface of the backing sheet such that the face sheet and backing sheet are readily separable. Preferably, the releasable adhesive covers the entire first surface of the face sheet. The releasable adhesive contains therein a first composition which, when exposed to a second composition, forms a distinctive color. The second composition is contained on the first surface of the backing sheet.

As used herein the terms releasable adhesive and fugitive adhesive are used interchangeably and refer to that class of adhesives which form weak cohesive bonds between the surfaces they contact so that bond failure occurs either by cohesive failure within the adhesive layer itself or by adhesive failure at the interface between the adhesive layer and one of the surfaces it contacts. The releasable adhesives are nontacky to the touch when dry.

Preferably, the first and second compositions are color former and color developer compounds conventional in the carbonless copy art. At least one of the compositions is preferably encapsulated and a plurality of capsules of the first composition are mixed with the releasable adhesive prior to application. The corresponding second composition is coated onto the first surface of the backing sheet prior to lamination. When an imaging force is applied to the face sheet, the capsules of the first composition are ruptured, mix with the second composition coated on the surface of the backing sheet and form a distinctive color to duplicate the information added to the face sheet.

Additional intermediate layers may be present in the laminate construction to provide additional copies of the information. Thus, an intermediate sheet may be interposed between the face sheet and the backing sheet. The intermediate sheet will have the second composition coated onto the surface which is in contact with the releasable adhesive. A second layer of releasable adhesive containing the first composition will be coated onto the opposite surface of the intermediate sheet which is in contact with the backing sheet.

In another embodiment of the invention, a laminate construction is provided which includes a backing sheet and a face sheet covering at least a portion of the backing sheet. A releasable adhesive secures a first surface of the face sheet to a first surface of the backing sheet. In this embodiment, both the first and second compositions are contained in the releasable adhesive layer. Preferably, one or both of the first and second compositions are encapsulated. Upon the application of an imaging force, the capsules are ruptured, the compositions combine and a distinctive color develops in the area of the imaging force.

In yet another embodiment of the invention, a laminate construction is provided which includes a backing sheet and a face sheet which covers at least a portion of the backing sheet. The backing sheet has on a first surface thereof both first and second compositions which, when combined, yield a distinctive color. A releasable adhesive secures a first surface of the face sheet to a first surface of the backing sheet such that the two plies are easily separable. Preferably, one or both of the first and second compositions are encapsulated. Upon the application of an imaging force, the capsules on the surface of the backing sheet are ruptured, the compositions combine, and a distinctive color develops in the area beneath the imaging force.

In still another embodiment of the invention, a laminate construction is provided which includes a backing sheet having on a first surface thereof a first composition. A face sheet overlies at least a portion of the backing sheet and has coated on a first surface thereof a second composition. The releasable adhesive secures the respective first surfaces of the face and backing sheets together. The releasable adhesive is permeable to one or both of the first and second compositions. When an imaging force is applied, at least one of the first and second compositions migrates through the adhesive to combine with the other composition in the area beneath the imaging force.

In all of the embodiments of the invention, one or more intermediate plies may be included in the laminate construction. These intermediate plies provide additional duplicate copies of the information added to the top ply. Such additional intermediate plies are particularly useful When the construction of the present invention is used as a business form or the like, where multiple file copies are required.

Moreover, the laminate construction of the present invention may also include a layer of pressure sensitive adhesive on the second surface of the backing sheet protected by a release liner or the like. Such a construction is particularly useful when the backing sheet portion of the laminate construction is to be used as a tag or label which can be adhered to a substrate as desired. The face sheet remains nontacky and can be easily handled and stored.

Accordindly, it is an object of the present invention to provide a laminate construction which is secured together by a releasable adhesive and which can be delaminated to provide a clean release, nontacky product. It is a further object of the present invention to provide a laminate construction in which information printed onto the face thereof is reproduced on the layer or layers beneath it. These and other objects and advantages of the invention will become apparent from the following detailed description, the accompanying drawings and the appended claims.

DESCRIPTION OF THE PREFERRED EMBODIMENTS

Figure 1:
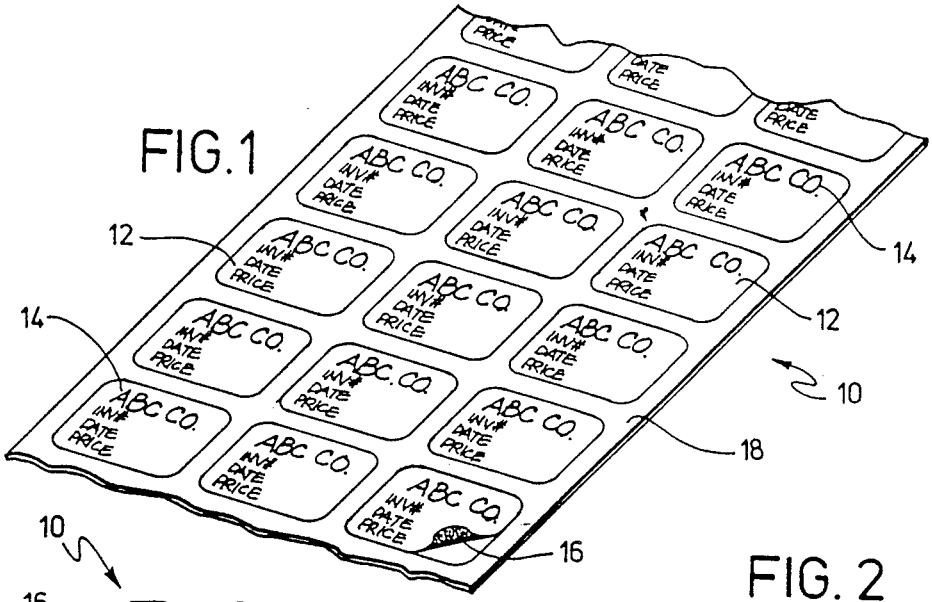
FIG. 1 is a fragmentary perspective view of a laminate construction made in accordance with the present invention.

The laminate construction 10 of the present invention is illustrated in FIG. 1 and includes a face sheet 12 which is imprinted with legible indicia 14. As shown, the laminate construction of the present invention may be advantageously formed on a continuous web of backing material 18 so that a multiplicity of individual tags labels and the like may be carried on it. The individual face sheets 12 are secured to the backing material 18 by a releasable adhesive 16.

While the invention has been illustrated in terms of a label construction it will be apparent that it is applicable to many other end uses. For example, full sized business forms may be constructed using the laminate construction of the present invention. In such constructions, the die cutting would be on a much larger scale so that each cut out entity would be the size of a business form.

Both the backing and face material are typically paper or paper-like material. However where it is desired to produce identification cards, nameplates or the like, either or both of the face or backing material may be of thin flexible plastic or a thin metallic foil or metal-coated plastic. The only requirement is that the face sheet be sufficiently flexible so that when its surface is subjected to an imaging force the information is transferred to the backing member.

A suitable releasable adhesive material for use in the invention may be any adhesive which has a low cohesive strength, bonds well to paper or plastic, and is nontacky to the touch when dry. The adhesive may be applied to a surface in a fluid state and then converted to a solid by heat, cooling, radiation, or a chemical reaction. Suitable classes of releasable adhesives include water based, hot melt, solvent based and so-called 100% solids adhesives preferred adhesives are water-based polymer latexes or hot melts such as waxes or polymeric resins.

An especially preferred class of adhesives may be chosen from blends of polyvinyl acetate and polyethylene emulsions. Such blends are formulated by varying the ratio of these two emulsions. Such adhesives are commercially available. The peel strength of these blends may be varied by varying the ratios of polyvinyl acetate to polyethylene.

Suitable physical properties for such a releasable adhesive are: a viscosity of from 3500 to 4500 centipoise at 30 degrees centigrade: a specific gravity of 0.98 to 1.15 grams per cubic centimeter; an oven dry solids content of 43% to 58%; and a pH from 4.5 to 8.5. The adhesive is preferably applied at a rate of from about 3.0 to about 22.0 grams per square meter, and most preferably about 3.0 to about 12.0 grams per square meter, based on dry weight.

The releasable adhesive provides a uniform nonfiber tearing clean release from paper or plastic. preferred release levels may be in the range of from about 100 to about 500 grams per five centimeters of width, although somewhat higher and lower values are operational. The release test is conducted at 90 degree peel at 1500 centimeters per minute by delaminating the face material from the backing sheet. A releasable adhesive suitable for use in the present invention may generally be identified as one in which cohesive failure occurs as the face sheet is peeled from the backing sheet. Cohesive failure is defined as that which occurs within the layer of adhesive. Adhesive failure is also acceptable. Adhesive failure is defined as failure at the interface between the adhesive and one of the surfaces it contacts.

The imaging capability of the present invention is brought about by the positioning of two colorless reactants which when combined, react to form a colored composition in the area between the surfaces of the face and backing sheets. This may be accomplished a number of ways, described in further detail below, all of which are within the scope of the present invention. The colorless reactants utilized in the practice of the present invention are also found in conventional carbonless copy products. Preferably, one or both of the reactant compositions is encapsulated to isolate the reactants from each other.

Figure 2:
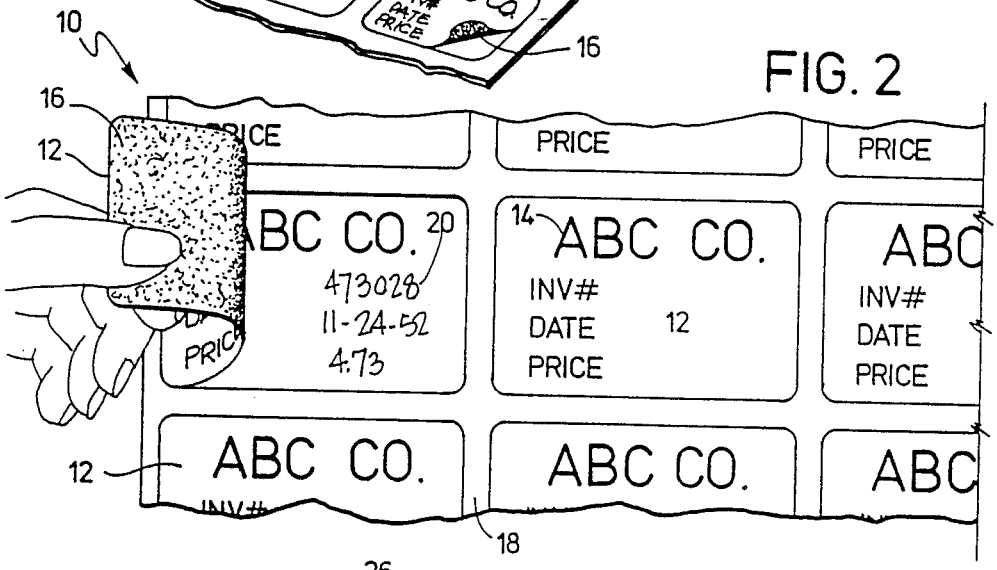
FIG. 2 is a fragmentary plan view showing the top face layer or ply partially peeled back revealing the duplicate information carried on the backing sheet.
Figure 3:
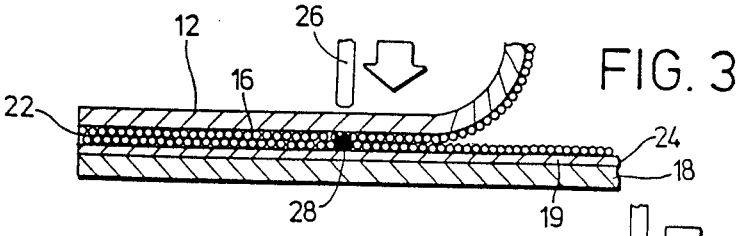
FIG. 3 is a fragmentary sectional view of one embodiment of the present invention.

Upon the application of an imaging force to the face sheet, the two co-reactants are brought together in the area beneath the imaging force and form a colored image identical to the one made on the face sheet. As shown in FIG. 2 to a preprinted label or face sheet 12, additional information can be added to the face sheet in the form of further indicia 20. This further indicia appears in duplicate form on backing sheet 18 by the reaction of the two color forming compositions. The indicia may be added to face sheet 12 by hand or mechanically such as by a typewriter or a computer-operated impact printer.

By way of example only, the labels in FIGS. 1 and 2 are shown to contain information relating to a product invoice number, a date, and a price. As shown, the face sheet may be readily peeled away from the construction and used as desired The backing sheet contains a duplicate copy of the information contained on the face sheet.

Referring now to FIGS. 3–7, various embodiments of the laminate construction of the present invention are illustrated. The laminate construction shown in FIG. 3 may be produced as follows. A first color former composition is dissolved in a suitable solvent and the solution is encapsulated as is known in the art, preferably with water as the continuous phase. The first color forming composition may be any of the several known color formers such as leuco dyes and the like. The capsule slurry may be used as produced with the water phase, or all or a part of the water may be removed.

The microcapsules of the first color former composition 22 are blended into the releasable adhesive 16. For example, a water-based releasable adhesive such as a blend of emulsions of polyvinyl acetate and polyethylene may be used. If a hot melt adhesive is utilized the microcapsules must be separated from the water slurry prior to mixing with the adhesive. Typically, such a hot melt adhesive may take the form of a blend of waxes, resins, and plasticizers.

A second color developer composition 24 is then printed or otherwise applied onto the top surface 19 of backing sheet 18. Suitable color developer coatings, known in the art as CF coatings include acid clay. phenolic resin, and zinc salicylate. Alternatively, the backing sheet 18 may be purchased commercially with the color developer layer already coated thereon. Such sheets are available commercially from Appleton Paper Company or the Mead Corporation.

At a coating station the releasable adhesive and microcapsule blend is coated onto either the lower surface of face sheet 12 or the top surface of backing sheet 18. The two sheets are then brought together such as at the nip between two pressure rolls, causing the adhesive to form a bond between the two sheets. The laminated web is then heated to dry the adhesive (if a water-based adhesive was used) or cooled (if a hot melt adhesive was used).

The continuous web of the laminate is then converted into a continuous backing sheet carrying multiple labels or the like at a die cutting station. At the die cutting station the laminated web is passed through a conventional label press where printed indicia 14 are repetitively printed onto the top of the continuous face sheet. The face sheet is then die cut into separate labels, and the matrix portion between labels is removed resulting in a construction as illustrated in FIG. 1.

The labels may now be imprinted with other information such as product codes inventory numbers, and prices etc. The indicia 20 may be added by hand, or by mechanical means such as typewriters or impact printers. The imaging force, shown schematically as 26 which produces the image on the front of the face sheet 12 transfers through that sheet and causes microcapsules 22 beneath the face sheet to rupture. The color former which is released from the microcapsules 22 comes into contact with the color developer layer 24, causing formation of a colored image 28 on the upper surface of backing sheet 18. The image formed is identical to the image formed on the top surface of the face sheet 12.

The label may now be peeled from the backing sheet 18 as shown in FIG. 2. The use of a releasable adhesive facilitates this removal because of the cohesively weak nature of the adhesive, or because the adhesive bond with either the face or backing sheet is weak. The label which is removed is nontacky on its lower surface and can be readily and easily handled. The upper surface of the backing sheet contains a duplicate copy of the information on the label and also has a nontacky surface.

Figure 4:
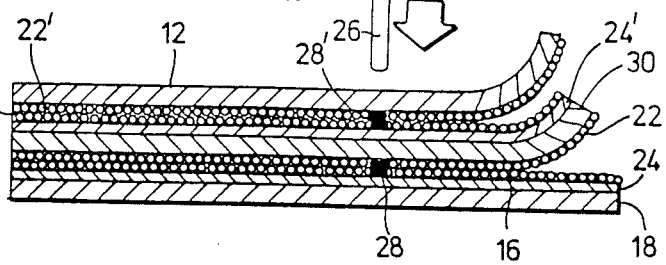
FIG. 4 is a fragmentary sectional view of another embodiment of the present invention.

An alternate laminate construction is illustrated in FIG. 4. That construction provides two duplicate copies of the information rather than the single copy provided by the construction in FIG. 3. This capability is accomplished by providing an additional intermediate sheet 30. Sheet 30 has a color developer layer 24' thereon and is secured to backing sheet 18 with the same microcapsule-containing releasable adhesive, shown as elements 16' and 22', respectively. When die cutting to form separate labels, the cutting blade is adjusted to cut through both face sheet 12 and intermediate sheet 30. Alternatively, the blade may be adjusted so that only face sheet 12 is cut. While not shown, it is immediately apparent that additional copies may be provided by utilizing additional intermediate layers in the construction.

Figure 5:
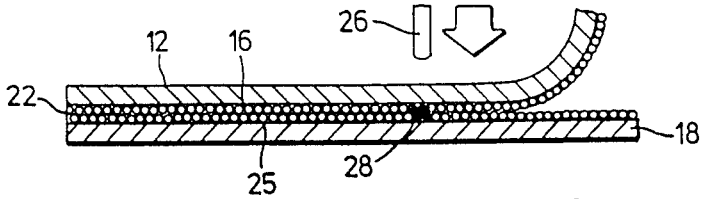
FIG. 5 is a fragmentary sectional view of yet another embodiment of the present invention.

Referring now to FIG. 5, another embodiment of the invention is shown. In this embodiment, the backing sheet 18 is not precoated with a color developer composition. Rather, both the color former and color developer compositions are encapsulated and blended with releasable adhesive 16 in the laminate construction. Thus, both color former microcapsules 22 and color developer microcapsules 25 are present in the adhesive layer between the face sheet 12 and backing sheet 18. When imaging force 26 impacts face sheet 12, the microcapsules beneath are ruptured, the reactants combine, and a colored area 28 forms on the surface of backing sheet 18.

Figure 6:
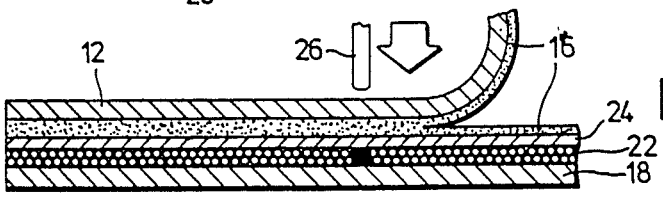
FIG. 6 is a fragmentary sectional view of yet another embodiment of the present invention.

Yet another embodiment of the invention is shown in FIG. 6 which depicts a construction which is simple to manufacture. As can be seen, a so-called self-contained carbonless sheet may be used as the backing sheet for this embodiment. Such self-contained sheets are commercially available and include a color developer layer 24 overlying a layer of microencapsulated color former composition 22. Thus no microcapsules need to be added to releasable adhesive layer 16 prior to lamination of face sheet 12 with backing sheet 18.

Figure 7:
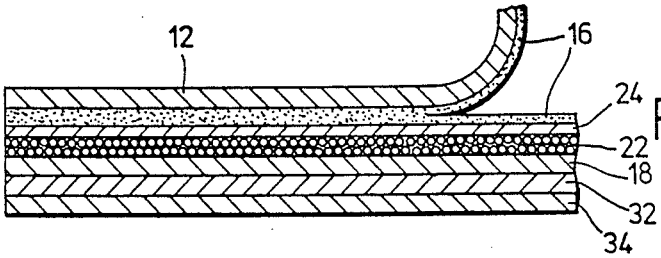
FIG. 7 is a fragmentary sectional view of still another embodiment of the present invention.

FIG. 7 illustrates yet another variation in construction. The embodiment of the invention illustrated in FIG. 7 shows the added feature of a layer of pressure sensitive adhesive 32 on the lower surface of backing sheet 18. The adhesive 32 is covered by a protective release liner 34. This particular construction permits the user to remove a label from the carrier sheet and then secure the carrier sheet to another substrate such as a package or the like. In this embodiment die cutting extends through all layers except the release liner.

Figure 8:
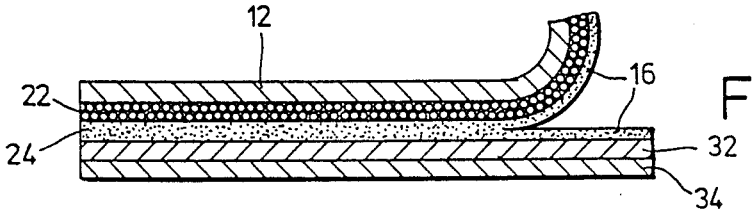
FIG. 8 is a fragmentary sectional view of another embodiment of the present invention.
Figure 9:
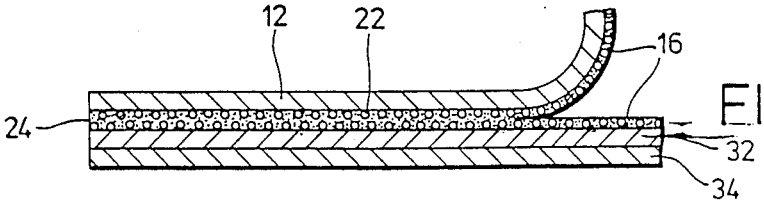
FIG. 9 is a fragmentary sectional view of an additional embodiment of the invention.

FIGS. 8 and 9 illustrate other modifications of the invention which can provide cost savings in construction of the laminate by eliminating the need for a backing sheet. In these embodiments of the invention, the backing sheet is replaced by a relatively thicker coating of the releasable adhesive 16 which is made to contain one or both of the color forming and color developing compositions, preferably the releasable adhesive 16 also has added to it an opacifying agent such as a colored pigment or the like which will provide a contrasting background for the developed color.

FIG. 8 shows the embodiment where releasable adhesive 16 contains color developer composition 24 therein, and the face sheet 12 has encapsulated color former composition 22 on its first (lower) surface. In constructing the laminate shown in FIG. 8, the first (lower) surface of face sheet 12 is first coated with encapsulated color former composition 22 in a manner previously described. Alternatively, a commercially available color back(CB) sheet may be used. The releasable adhesive 16 containing color developer composition 24 is then coated over color former composition 22 and then dried.

A release liner 34 having one surface thereof coated with pressure sensitive adhesive 32 is then laminated to face sheet 12 with the pressure sensitive adhesive 32 against the dried releasable adhesive 16. The laminate construction may now be printed with indicia and die cut as previously described, leaving the release liner ply 34 uncut and intact. The laminate may then be imaged by a impact force.

The entire laminate construction may then be peeled away from release liner 34 and adhered to a substrate using the pressure sensitive adhesive 32. Subsequently, the face sheet 12 may be peeled away from the remainder of the laminate, causing cohesive failure of the releasable adhesive 16 or failure at the interface between the face sheet and adhesive. All or a part of the releasable adhesive 16 remains covering pressure sensitive adhesive 32, leaving the image which was formed by the impact force and also leaving the surface to which the laminate was attached clean and nontacky.

The embodiment illustrated in FIG. 9 is a variation on the FIG. 8 embodiment. In this embodiment, both the color forming composition 22 and the color developer composition 24 are blended into the releasable adhesive 16. As previously described, either or both of the color forming reactants may be encapsulated. The laminate is then imaged, and the release liner 34 is peeled away to adhere the laminate to a substrate. The face sheet 12 can be subsequently peeled away leaving an intact image and a clean nontacky surface.

Other modifications within the scope of the present invention will occur to those skilled in the art. For example, the color developer may be encapsulated and the color former may be coated onto the upper surface of the backing sheet. The face sheet in the construction may be a coated back sheet which can contain the color former encapsulated on the lower surface of the face sheet. The color developer may be then blended with the releasable adhesive.

It is also possible to use a coated back (CB) sheet for the face sheet, a coated front (CF) sheet for the backing sheet, and a releasable adhesive which is permeable to the color former, the color developer, or both. When the imaging force is applied the microcapsules rupture, and the exuded liquid flows or migrates to the CF surface below and forms color on the surface of the backing sheet.

The capability of providing multiple duplicate copies as in FIG. 4 can be extended to the other embodiments of the invention as can the capability of attaching the backing sheet to another substrate as shown by FIG. 7. Moreover while all of the constructions are shown with the imaging means and adhesive coatings coextensive over the entire areas of the laminate, it will be apparent that it may be desirable in some instances to avoid imaging means and/or adhesive in certain areas of the construction. For example if one edge or corner of the face sheet is left unbonded, it is easier to grasp it and peel the face sheet from the laminate construction.

While certain representative embodiments and details of the invention have been shown for purposes of illustration, it will be apparent to those skilled in the art that various other changes in the methods and apparatus disclosed herein may be made without departing from the scope of the invention which is defined in the appended claims.

What is claimed is:

1. A laminate construction comprising a backing sheet, a face sheet covering at least a portion of said backing sheet, and a releasable adhesive securing a first surface of said face sheet to a first surface of said backing sheet such that said face sheet and backing sheet are readily separable, said releasable adhesive containing therein a first color former composition which, when exposed to a second color developer composition, forms a distinctive color, at least one of said first and second compositions being contained in a plurality of capsules which rupture upon the application of an impact force on said face sheet, and said backing sheet having on said first surface thereof said second composition.

2. The laminate construction of claim 1 including an intermediate sheet interposed between said face sheet and said backing sheet, a first layer of said releasable adhesive securing a first surface of said intermediate sheet to said first surface of said face sheet and a second layer of said releasable adhesive securing the opposite surface of said intermediate sheet to said first surface of said backing sheet, said intermediate sheet having on said first surface thereof said second composition.

3. The laminate construction of claim 1 including a layer of pressure sensitive adhesive on the second surface of the backing sheet.

4. The laminate construction of claim 3 including a release liner overlying said pressure sensitive adhesive layer.

5. A laminate construction comprising a backing sheet, a face sheet covering at least a portion of said backing sheet, and a releasable adhesive securing a first surface of said face sheet to a first surface of said backing sheet, said releasable adhesive containing therein a first color former composition and a second color developer composition which, when combined with said first composition, forms a distinctive color, at least one of said first and second compositions being contained in a plurality of capsules which rupture upon the application of an impact force on said face sheet.

6. The laminate structure of claim 5 including an intermediate sheet interposed between said face sheet and said backing sheet, said intermediate sheet having said releasable adhesive on both surfaces thereof.

7. The laminate construction of claim 5 including a layer of pressure sensitive adhesive on the second surface of the backing sheet.

8. The laminate construction of claim 7 including a release liner overlying said pressure sensitive adhesive layer.

9. A laminate construction comprising a backing sheet having on a first surface thereof a first color former composition and a second color developer composition which, when combined, form a distinctive color, at least one of said first and second compositions being contained in a plurality of capsules which rupture upon the application of an impact force, a face sheet covering at least a portion of said backing sheet, and a releasable adhesive securing a first surface of said face sheet to a first surface of said backing sheet such that said face sheet and backing sheet are readily separable.

10. The laminate construction of claim 9 including a layer of a pressure sensitive adhesive on the second surface of said backing sheet.

11. The laminate construction of claim 10 including a release liner overlying said pressure sensitive adhesive layer.

12. The laminate structure of claim 9 including an intermediate sheet interposed between said face sheet and said backing sheet, said intermediate sheet having said releasable adhesive on both surfaces thereof.

13. A laminate construction comprising a backing sheet having on a first surface thereof a first color former composition which, when combined with a second color developer composition, forms a distinctive color, at least one of said first and second compositions being contained in a plurality of capsules which rupture upon the application of an imaging force, a face sheet having on a first surface thereof said second composition, and a releasable adhesive securing said first surface of said backing sheet to said first surface of said face sheet, said releasable adhesive being permeable to at least one of said first and second compositions such that when an imaging force is applied, at least one of said first and second composition migrates to combine with the other composition in the area of said imaging force.

14. A laminate construction comprising a backing sheet, a face sheet covering at least a portion of said backing sheet, and a releasable adhesive securing a first surface of said face sheet to a first surface of said backing sheet such that said face sheet and backing sheet are readily separable, said face sheet having on said first surface thereof a first color former composition, and said releasable adhesive containing therein a second color developer composition which, when exposed to said first composition, forms a distinctive color, said first composition being encapsulated in a plurality of capsules which rupture upon the application of an impact force on said face sheet.

15. A laminate construction comprising a face sheet, said face sheet having on a first surface thereof a first color former composition, a releasable adhesive secured to said first surface of said face sheet, said releasable adhesive containing therein a second color developer composition which, when exposed to said first composition, forms a distinctive color, at least one of said first and second compositions being contained in a plurality of capsules which rupture upon the application of an imaging force.

16. The laminate construction of claim 15 including a release liner overlying said pressure sensitive adhesive layer.

17. The laminate construction of claim 15 in which said releasable adhesive also contains an opacifying agent.

18. A laminate construction comprising a face sheet, said face sheet having on a first surface thereof a releasable adhesive, said releasable adhesive containing therein a first color former composition and a second color developer composition which, when exposed to said first composition, forms a distinctive color, at least one of said first and second compositions being contained in a plurality of capsules which rupture upon the application of an imaging force, and a layer of pressure sensitive adhesive on the opposite surface of said releasable adhesive.

19. The laminate construction of claim 18 including a release liner overlying said pressure sensitive adhesive layer.

20. The laminate construction of claim 18 which said releasable adhesive also contains an opacifying agent.

21. A laminate construction comprising a backing sheet having on a first surface thereof a first color former composition and a second color developer composition which, when combined, form a distinctive color, at least one of said first and second compositions being contained in a plurality of capsules which rupture upon the application of an impact force, a face sheet covering at least a portion of said backing sheet, and a releasable adhesive positioned between said face sheet and said backing sheet.

22. The laminate construction of claim 21 including a layer of pressure sensitive adhesive on the second surface of said backing sheet.

23. The laminate construction of claim 22 including a release liner overlying said pressure sensitive adhesive layer.

* * * * *